US010934745B2

(12) United States Patent
Liu

(10) Patent No.: US 10,934,745 B2
(45) Date of Patent: Mar. 2, 2021

(54) CORE REPLACEABLE HOCKEY LOCK

(71) Applicant: FEDERAL LOCK CO., LTD., Pingtung County (TW)

(72) Inventor: Tien-Kao Liu, Pingtung County (TW)

(73) Assignee: Federal Lock Co., Ltd., Pingtung County (TW)

( * ) Notice: Subject to any disclaimer, the term of this patent is extended or adjusted under 35 U.S.C. 154(b) by 275 days.

(21) Appl. No.: 16/249,176

(22) Filed: Jan. 16, 2019

(65) Prior Publication Data

US 2020/0224459 A1 Jul. 16, 2020

(51) Int. Cl.

| | |
|---|---|
| ***E05B 67/24*** | (2006.01) |
| ***E05B 67/02*** | (2006.01) |
| ***E05B 67/36*** | (2006.01) |
| ***E05B 17/18*** | (2006.01) |

(52) U.S. Cl.

CPC ..... *E05B 67/24* (2013.01); *E05B 17/185* (2013.01); *E05B 67/02* (2013.01)

(58) Field of Classification Search

CPC ..... E05B 67/24; E05B 17/185; E05B 67/02; E05B 67/36; E05B 67/00; E05B 67/38; E05B 17/183; E05B 67/22; E05B 67/365

USPC ..... 70/31–35, 38 R, 52, 53, 367–371, 386, 70/417, 423–428, 455

See application file for complete search history.

(56) References Cited

U.S. PATENT DOCUMENTS 3,930,391 A * 1/1976 Borlinghaus ..... E05B 17/185 70/455
4,464,915 A * 8/1984 Moshe ..... E05B 67/02 70/417
4,848,110 A * 7/1989 Kuo ..... B60R 25/0221 70/38 C
4,881,391 A * 11/1989 Villa ..... E05B 17/185 70/455
5,063,765 A * 11/1991 Squire ..... E05B 15/1614 70/417
5,682,775 A * 11/1997 Baber ..... E05B 65/0864 70/34
6,766,671 B2 * 7/2004 Haczynski ..... E05B 67/36 70/23

(Continued)

*Primary Examiner* — Lloyd A Gall
(74) *Attorney, Agent, or Firm* — Rosenberg, Klein & Lee

(57) ABSTRACT

A core replaceable hockey lock includes a first end face and a second end face. The first end face includes a first cavity, a second cavity, a third cavity and a fourth cavity. The end face includes a core hole which communicates with the second cavity. A lateral hole is defined radially in the lock and communicates with the first and fourth cavities. A locking member is located in the second cavity and includes a connection portion connected to the transmission portion, and a stop plate which slides in the third cavity when the locking member is rotated. A locking part is located in the fourth cavity. A shackle is located in the lateral hole and includes a neck located corresponding to the fourth cavity and the locking part. The first cavity and the core hole are parallel to each other. The core is replaceable by removing the cover.

18 Claims, 17 Drawing Sheets

(56) References Cited

U.S. PATENT DOCUMENTS

| | | | | |
|---|---|---|---|---|
| 8,776,557 | B2 * | 7/2014 | Wang | E05B 67/36 70/34 |
| 8,919,156 | B1 * | 12/2014 | Liu | E05B 9/084 70/32 |
| 8,978,426 | B2 * | 3/2015 | Wang | E05B 67/36 70/34 |
| 9,587,416 | B1 * | 3/2017 | Liu | E05B 67/02 |
| 9,683,390 | B1 * | 6/2017 | Liu | E05B 37/025 |
| 2004/0083777 | A1 * | 5/2004 | Vito | E05B 67/36 70/32 |
| 2005/0252257 | A1 * | 11/2005 | Woods | E05B 67/04 70/33 |
| 2006/0260368 | A1 * | 11/2006 | Reitchuk | E05B 67/36 70/33 |

* cited by examiner

CORE REPLACEABLE HOCKEY LOCK

BACKGROUND OF THE INVENTION

1. Fields of the Invention

The present invention relates to a hockey lock, and more particularly, to a core replaceable hockey lock.

2. Descriptions of Related Art

The hockey locks are used on doors of containers or large gates as shown in FIGS. 1 and 2, wherein the hockey lock 10 includes a first cavity 101 in one side thereof, and a hole 102 is located in the periphery of the lock 10. A core 20 is received in the hole 102 and includes a slot 201. A shackle 202 is connected to the core 20. An engaging hole 103 is defined in an inside of the first cavity 101. The shackle 202 is driven by the core 20 and engaged with the engaging hole 103 via the hole 102. A threaded hole 104 is defined in a surface of the lock 10 that is located perpendicular to the periphery of the lock 10. A bolt 30 is threadedly connected to the threaded hole 104 and reaches into the slot 201 to restrict the movement of the core 20.

It is noted that the core 20 is located to the periphery of the lock 10 so that the users cannot see the keyhole 203 and the core 20 directly, so that the users usually try several times to insert the key into the keyhole 203. Besides, the core 20 is secured to the shackle 202 and cannot be separated from each other, therefore, the users cannot replace the core 20 when needed. In other words, the users have to purchase multiple locks 10 of different cores 20 for different doors such as garage doors and entrance doors. The users need carry multiple keys for the locks 10. Once the core 20 is damaged, the whole lock 10 has to be replaced with a new one and the increases the related expenses.

The present invention intends to provide a core replaceable hockey lock to eliminate the shortcomings mentioned above.

SUMMARY OF THE INVENTION

The present invention relates to a core replaceable hockey lock and comprises a first end face and a second end face which is located opposite to the first end face. The first end face includes a first cavity, a second cavity, a third cavity and a fourth cavity defined therein. The second cavity communicates with the third cavity, and the fourth cavity is defined in an inner bottom of the third cavity. The second end face includes a core hole which communicates with the second cavity. A lateral hole is defined radially in the lock and communicates with the first and fourth cavities. A core is located in the core hole and includes a transmission portion on the first end thereof, and a keyhole is defined in the second end of the core. A locking member is located in the second cavity and includes a connection portion and a stop plate. The connection portion is connected to the transmission portion. The stop plate slides in the third cavity when the locking member is rotated. When the locking member is located at a first position, the stop plate seals the fourth cavity, and when the locking member is located at a second position, the stop plate does not seal the fourth cavity. A locking part is located in the fourth cavity and located corresponding to the stop plate. A shackle is located in the lateral hole and includes a neck which is located corresponding to the fourth cavity and the locking part. When the shackle is located at a locked position, the shackle is located in the first cavity and the neck is located at the fourth cavity. When the locking member is located at the first position, the stop plate stops the locking part from protruding into the fourth cavity, so that the locking part is engaged with the neck. When the locking member is located at the second position, the locking part protrudes into the fourth cavity and is separated from the neck, so that the shackle is moved to an unlocked position where the shackle is not engaged with the first cavity.

Preferably, the first end face includes a fixing hole, and the second end face includes a positioning recess which communicates with the fixing hole. The core hole is defined in the inner bottom of the positioning recess. A cover is mounted to the positioning recess so as to cover up the core and the positioning recess. The cover includes a bore which communicates with the keyhole. A fixing member extends through the fixing hole and fixed to the cover.

Preferably, the cover includes a stepped face facing the keyhole. The stepped face has an anti-break plate received therein. The anti-break plate is located corresponding to the passage of the keyhole.

Preferably, the first end face includes at least one protection plate which is mounted to the first, second and third cavities.

Preferably, the first end face includes a threaded hole which communicates with the lateral hole. A pin is connected to the threaded hole. The shackle includes a recess which is located corresponding to the pin so as to restrict the shackle to be moved between the locked position and the unlocked position.

Preferably, the lateral hole includes a first shoulder formed in the inner periphery thereof. The shackle includes a head on the top thereof. A pre-compressed resilient part is biased between the head and the first shoulder.

Preferably, the first cavity includes a fifth cavity defined in the inside wall thereof. The fifth cavity is located corresponding to the lateral hole. When at the locked position, the shackle is engaged with the fifth cavity.

Preferably, the core is connected with a sleeve radially. The core hole is shaped to accommodate the core and the sleeve.

Preferably, the sleeve includes an installation hole which is located corresponding to the first end face. The first end face includes a connection hole, and a connection member is connected to the connection hole from the first end face and is connected to the installation hole.

Preferably, a resilient member is located between the stop plate and an inside wall of the second cavity.

Preferably, the resilient member is a torsion spring.

Preferably, the locking part is a ball.

Preferably, the first end face includes a recessed face. The first cavity is defined in the inner bottom of the recessed face.

Preferably, an outer plate is mounted to the second end face and covers up the core and the keyhole when the outer plate is located at a closed position. When the outer plate is located at an opened position, the outer plate does not cover up the core and the keyhole. The outer cover includes a positioning pin. A positioning hole is defined through the first and second end faces, and located corresponding to the positioning pin. The positioning hole includes an inclined hole defined through the inside wall thereof. A positioning part is located in the positioning hole and connected to the positioning pin. A first spring member is a torsion spring and is biased between the positioning pin and the inside wall of the positioning hole so that the positioning pin drives the outer plate toward the closed position.

Preferably, the second end face includes an axial hole which includes a tube received therein. The tube includes a second spring member and an end member received therein. The tube includes a second shoulder formed in the inner periphery thereof. The second shoulder is located corresponding to the end member. The end member includes a protrusion which protrudes beyond the second shoulder. When the outer plate is located at the opened position, the outer plate contacts the lateral side of the protrusion by the first spring member.

Preferably, the connection portion is a protruded portion and the transmission portion is a notch which is shaped to accommodate the protruded portion.

Preferably, the transmission portion is a notch and includes a transmission member which is connected to the connection portion. The connection portion is a protruded portion and the transmission member is a notch which is shaped to accommodate the protruded portion.

Preferably, the connection portion and the transmission portion each are a hole. A transmission pin is located between the connection portion and the transmission portion.

The advantages of the present invention are that the lock includes the first cavity in the first end face, and the core hole in the second end face. The core is received in the core hole. The keyhole and the first cavity are located at the same direction so that the first cavity and the protection plate face the door when the lock is used to lock a door. The parts in the second, third and fourth cavities cannot be removed so as to have better anti-theft feature. The users can see the keyhole directly to easily insert the key into the keyhole.

After unlocking the lock, the core can be replaced by removing the cover and the housing of the lock is still used. This can reduce the expenses for designing, manufacturing and inventory cost. The users may use the same core to different locks and only one key is required so as to better manage the keys and the locks.

The anti-break plate prevents the core from being damaged from outside to protect the locks.

The outer plate is able to cover up the core and the keyhole when the outer plate is at the closed position, so as to prevent rain and dust from entering the locks. By pivoting the outer plate, the keyhole is exposed for convenience of unlocking the lock.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
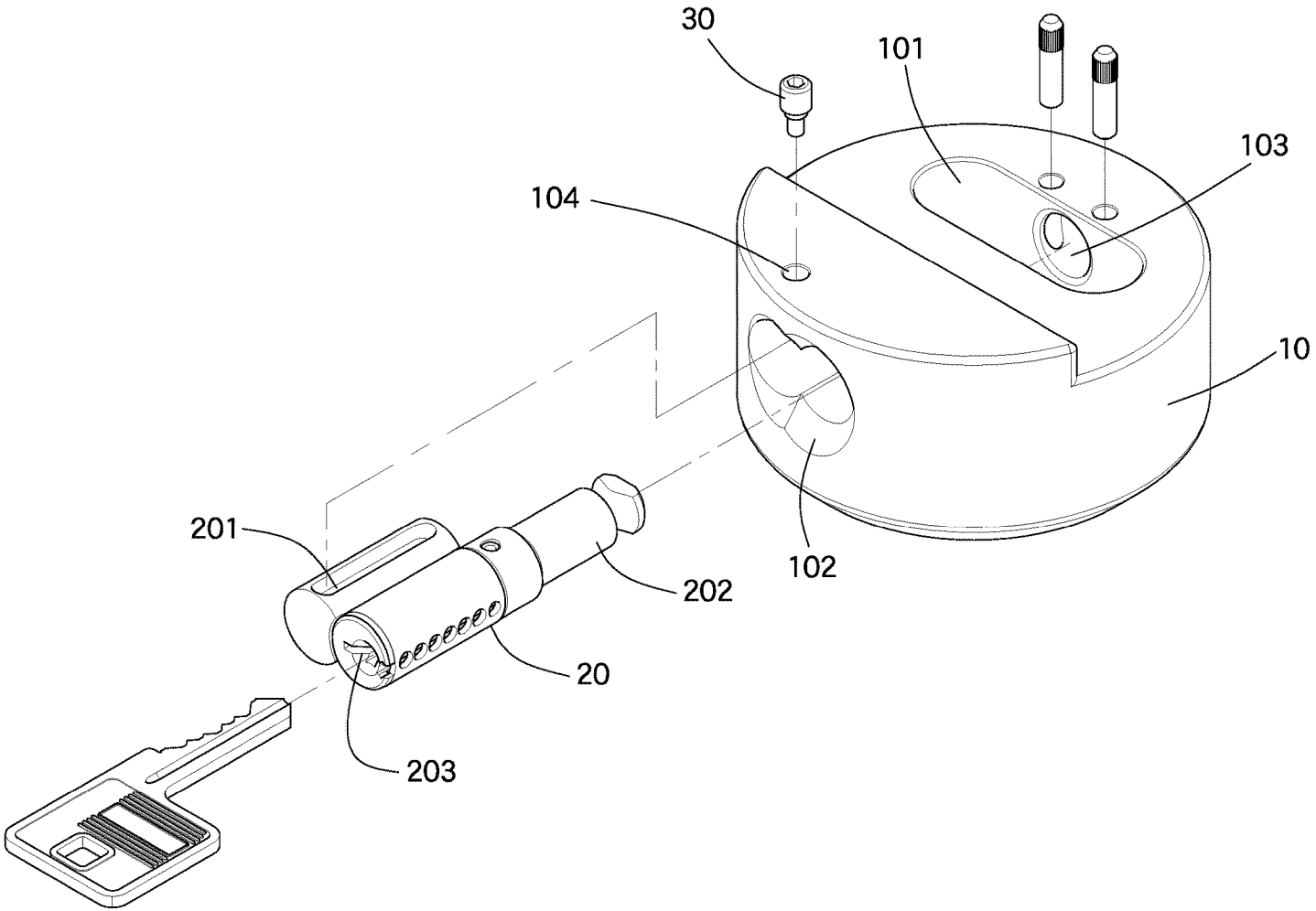
FIG. 1(PRIOR ART)
FIG. 1 is a perspective view to show a conventional hockey lock.
Figure 2:
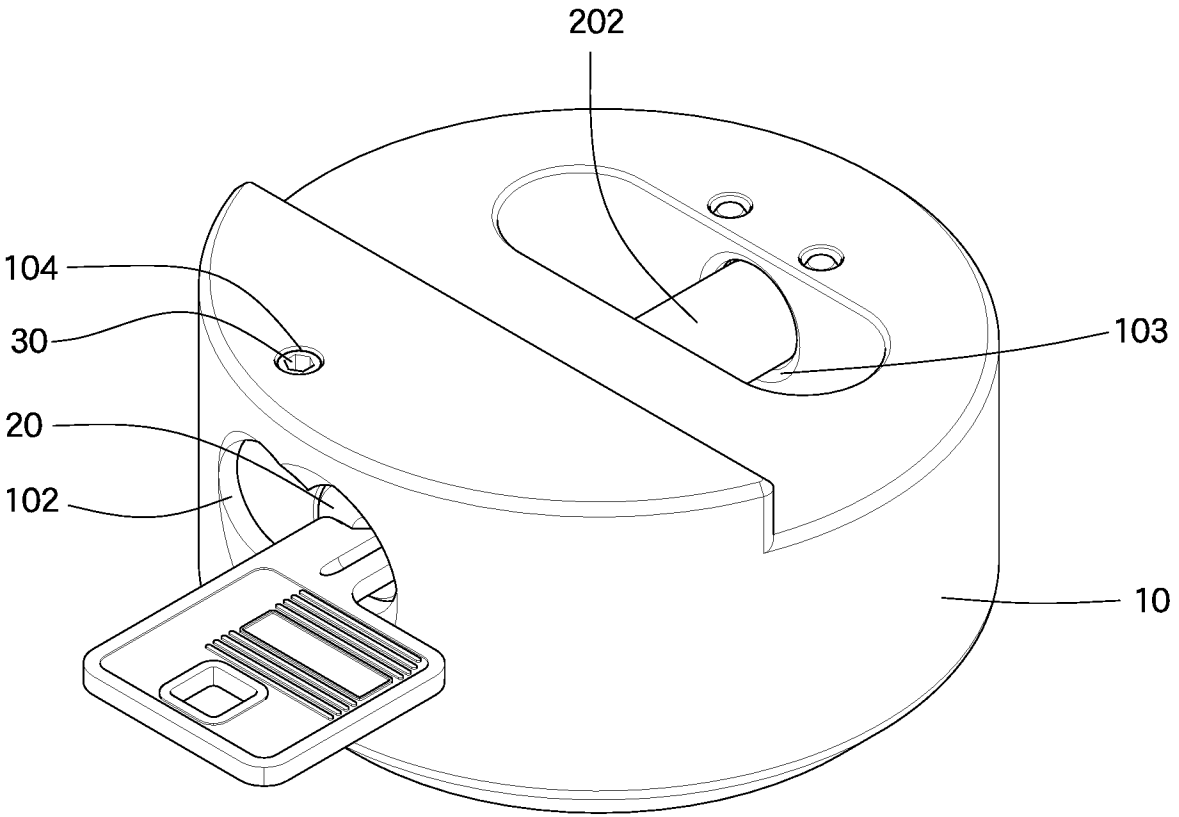
FIG. 2(PRIOR ART)
FIG. 2 is an exploded view to show a conventional hockey lock.
Figure 3:
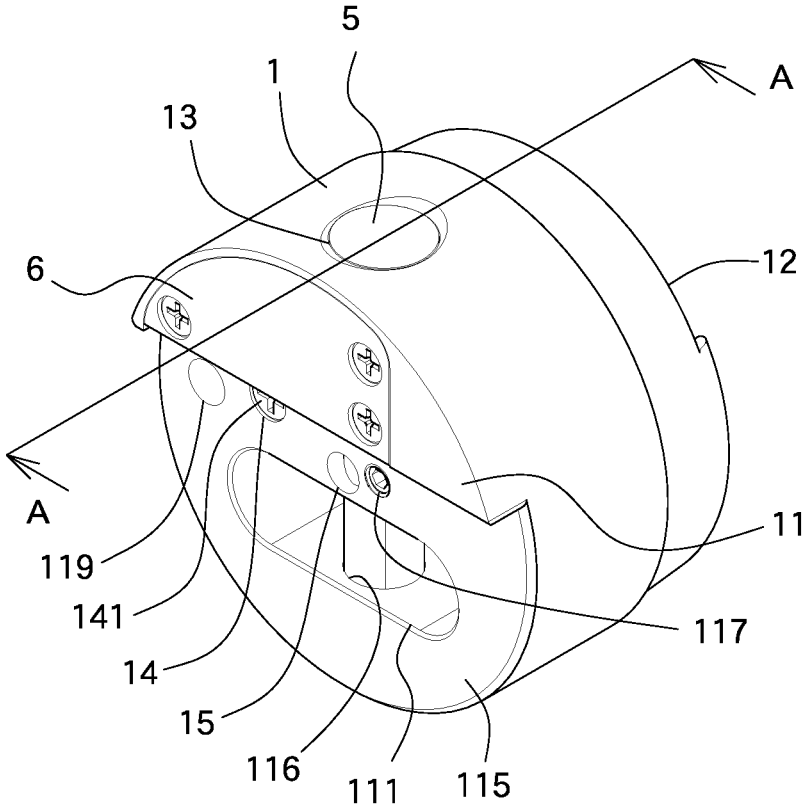
FIG. 3 is a perspective view to show the hockey lock of the present invention.

Referring to FIGS. 3 to 6, the core replaceable hockey lock 1 of the present invention comprises a first end face 11 and a second end face 12 which is located opposite to the first end face 11. The first end face 11 includes a first cavity 111, a second cavity 112, a third cavity 113 and a fourth cavity 114 defined axially therein. The second cavity 112 communicates with the third cavity 113, and the fourth cavity 114 is defined in the inner bottom of the third cavity 113. The second end face 12 includes a core hole 121 defined axially therein which communicates with the second cavity 112. A lateral hole 13 is defined radially in the lock 1 and communicates with the first and fourth cavities 111, 114. The first end face 11 includes a recessed face 115. The first cavity 111 is defined in the inner bottom of the recessed face 115.

A core 2 is located in the core hole 121 and includes a transmission portion 21 on the first end thereof, and a keyhole 22 is defined in the second end of the core 2.

A locking member 3 is located in the second cavity 112 and includes a connection portion 31 and a stop plate 32. The connection portion 31 is connected to the transmission portion 21. The stop plate 32 slides in the third cavity 113 when the locking member 3 is rotated. When the locking member 3 is located at a first position, the stop plate 32 seals the fourth cavity 114, and when the locking member 3 is located at a second position, the stop plate 32 does not seal the fourth cavity 114.

A locking part 4 is located in the fourth cavity 114 and located corresponding to the stop plate 32.

A shackle 5 is located in the lateral hole 13 and includes a neck 51 which is located corresponding to the fourth cavity 114 and the locking part 4.

Figure 7:
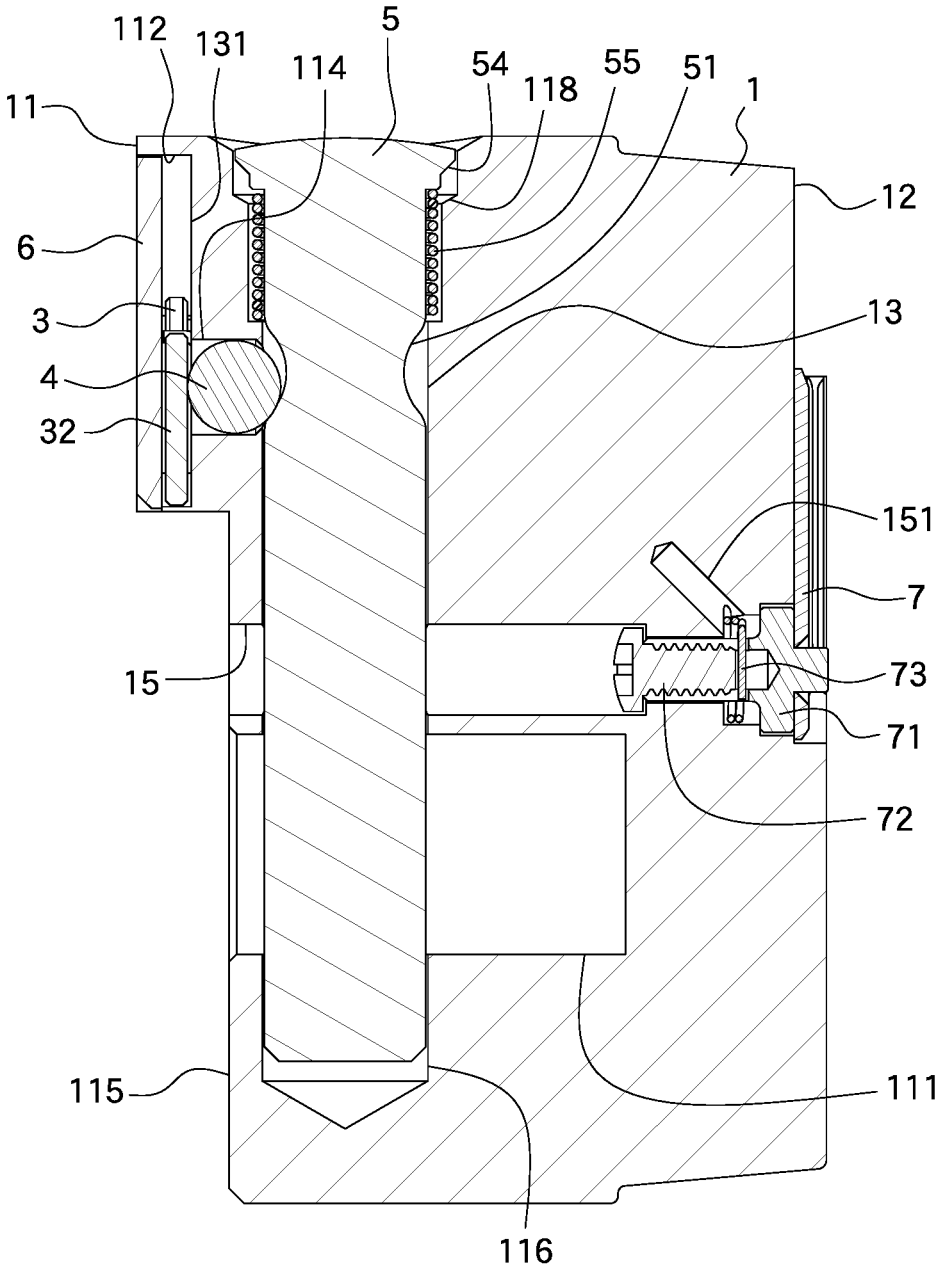
FIG. 7 is a cross sectional view, taken along line A-A in FIG. 3.
Figure 8:
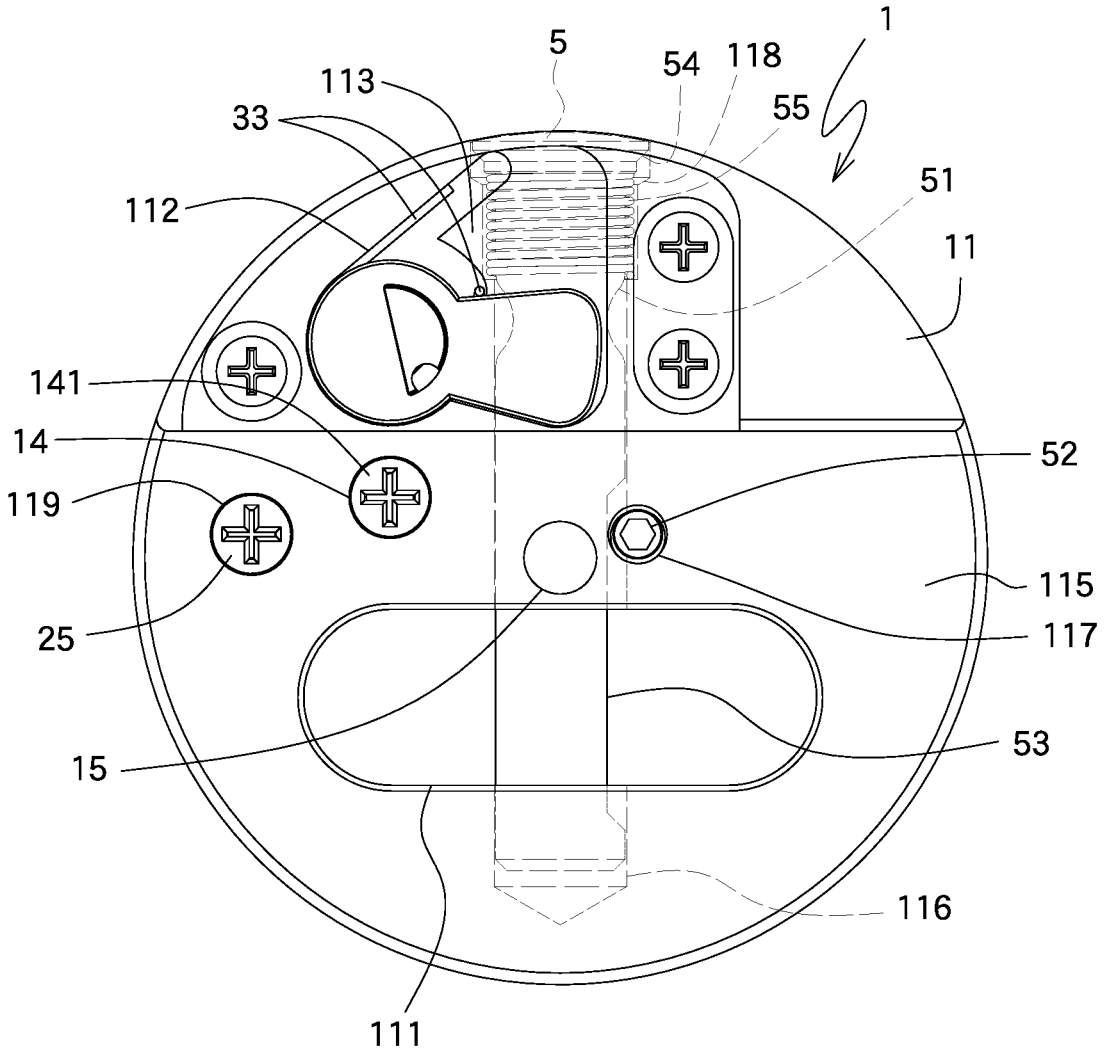
FIG. 8 shows that the protection plate is hidden and the locking member is at the first position.
Figure 9:
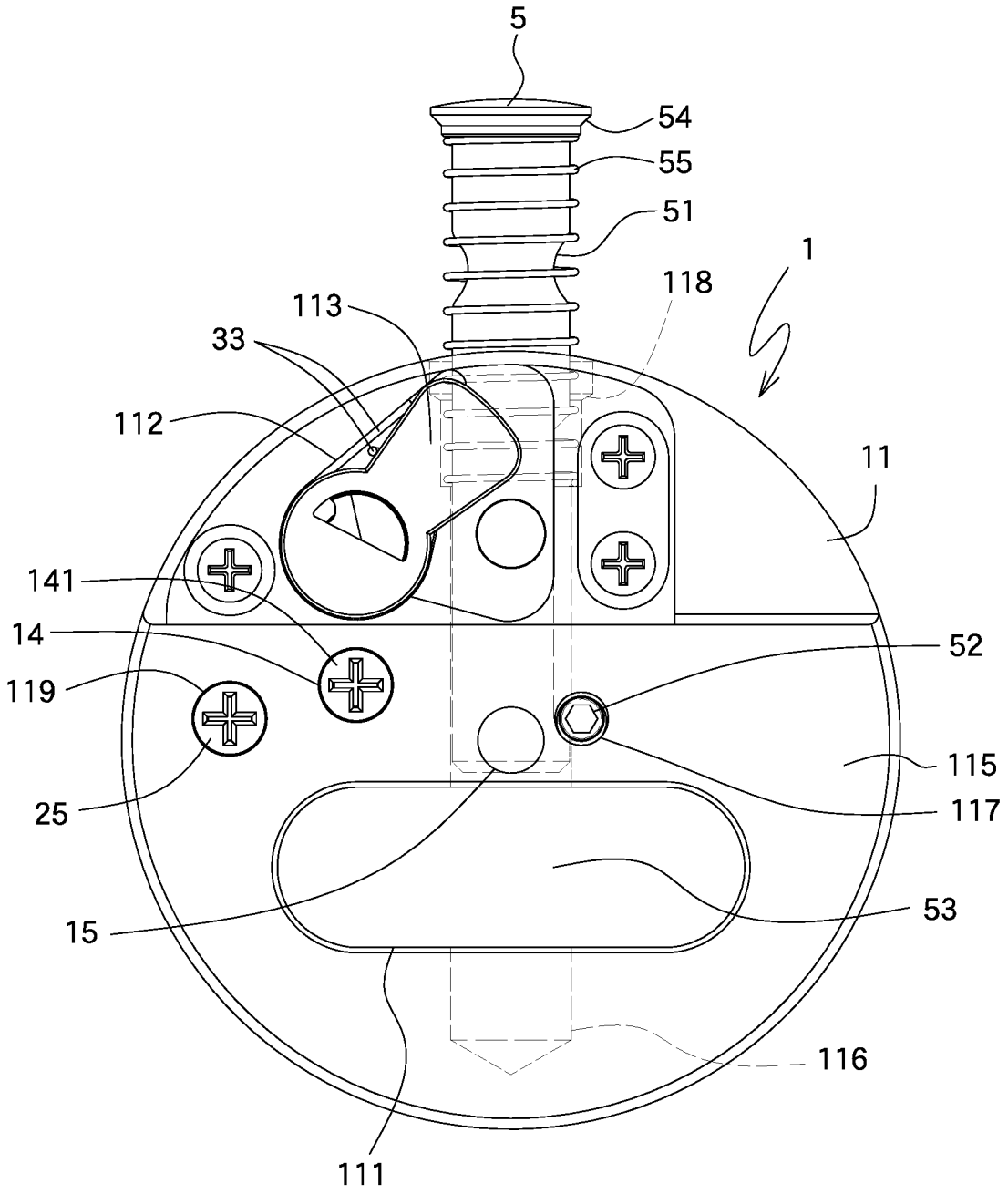
FIG. 9 shows that the protection plate is hidden and the locking member is at the second position, the lock is at the unlocked position.
Figure 10:
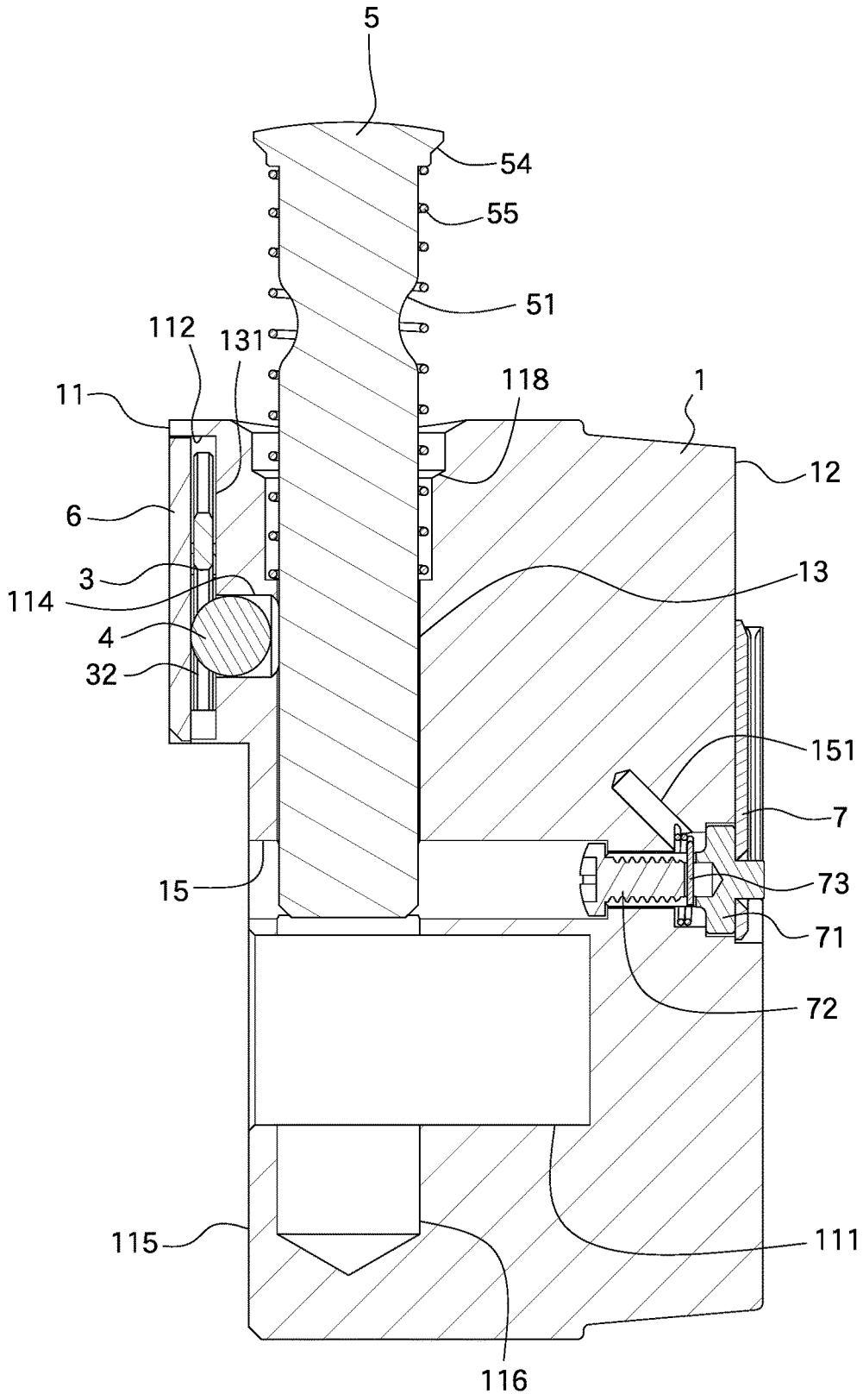
FIG. 10 is a cross sectional view, taken along line A-A in FIG. 3, and the lock is at the unlocked position.

The transmission portion 21 of the core 2 is connected to the connection portion 31 so that when the locking member 3 is rotated and located at the locked position as shown in FIG. 7, the shackle 5 is located in the first cavity 111, and the neck 51 is located at the fourth cavity 114. When the locking member 3 is located at the first position, as shown in FIG. 8, the stop plate 32 stops the locking part 4 from protruding into the fourth cavity 114, so that the locking part 4 is engaged with the neck 51. In order to enhance the positioning feature of the shackle 5 when at the locked position, the first cavity 111 includes a fifth cavity 116 defined in the inside wall thereof. The fifth cavity 116 is located corresponding to the lateral hole 13. When at the locked position, the shackle 5 is engaged with the fifth cavity 116. As shown in FIG. 9, when the core 2 rotates the locking member 3 to the second position, as shown in FIGS. 10, the locking part 4 protrudes into the fourth cavity 114 and is separated from the neck 51, so that the shackle 5 is moved to an unlocked position where the shackle 5 is not engaged with the first cavity 111 as shown in FIGS. 9 and 10.

For the feature of positioning of the locking member 3 and the locking part 4, in one embodiment, the first end face 11 includes at least one protection plate 6 which is mounted to the first, second and third cavities 112, 113, 114, so as to position the locking member 3 and the locking part 4 to the first, second and third cavities 112, 113, 114. This also restricts movement of the locking part 4. When the locking member 3 is at the second position, the locking part 4 protrudes from the fourth cavity 114 and separated from the neck 51, and the locking part 4 is also restricted by the wall of the protection plate 6. As shown in FIG. 10, when the locking member 3 is rotated from the second position to the first position, the stop plate 32 presses the locking part 4 into the fourth cavity 114 and located at the locked position. In order to allow the locking member 3 to easily press the locking part 4 into the fourth cavity 114, the locking part 4 is a ball which is easily pressed by the locking member 3. When the locking part 4 protrudes from the fourth cavity 114, the center of the locking part 4 does not locate beyond the locking member 3. The protection plate 6 not only protect and position the locking member 3 and the locking part 4, it can also restricts the position of the locking part 4 relative to the fourth cavity 114. In this embodiment, the protection plate 6 is fixed to threaded holes in the lock 1 by bolts.

Figure 5:
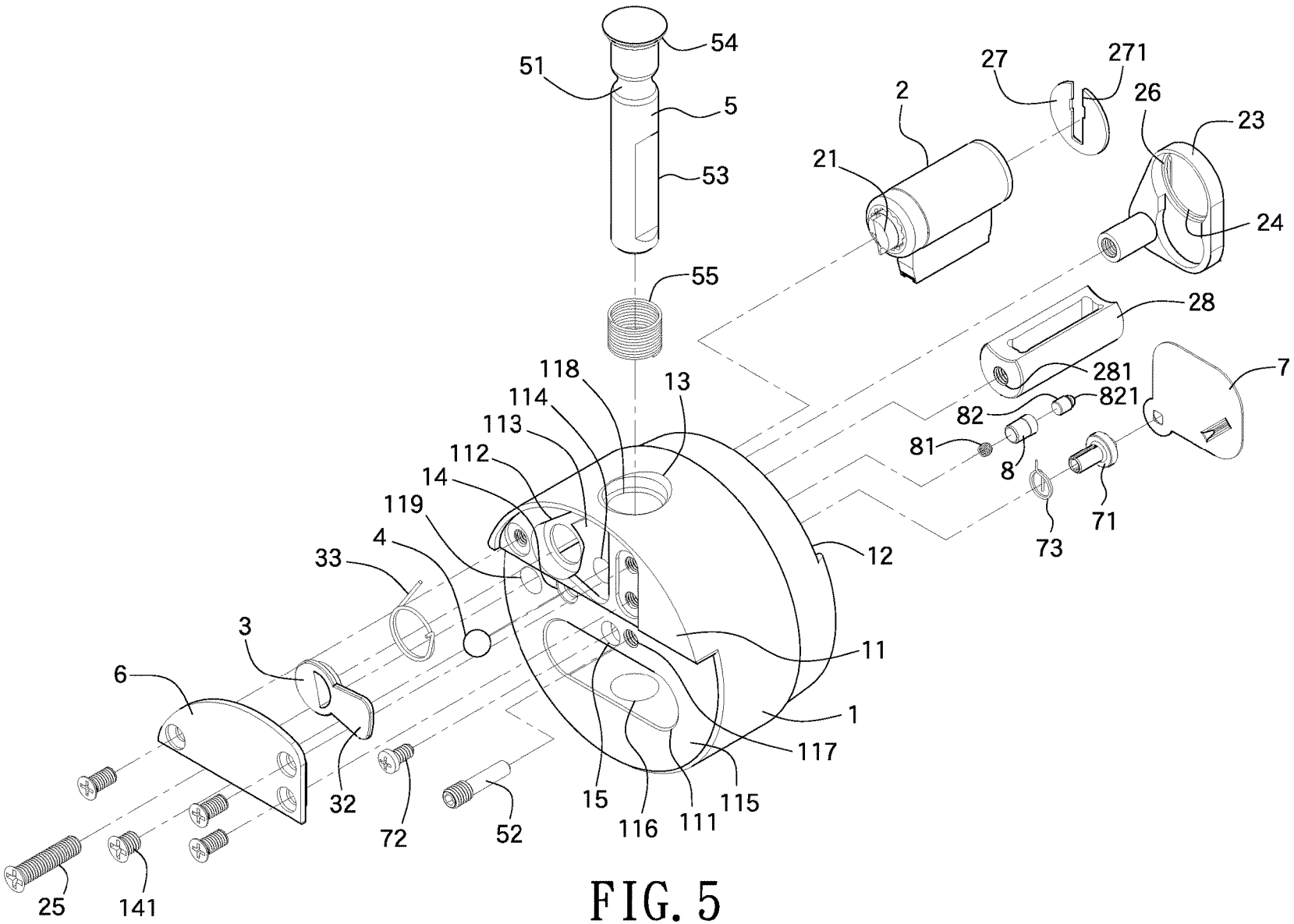
FIG. 5 is an exploded view to show the hockey lock of the present invention.
Figure 6:
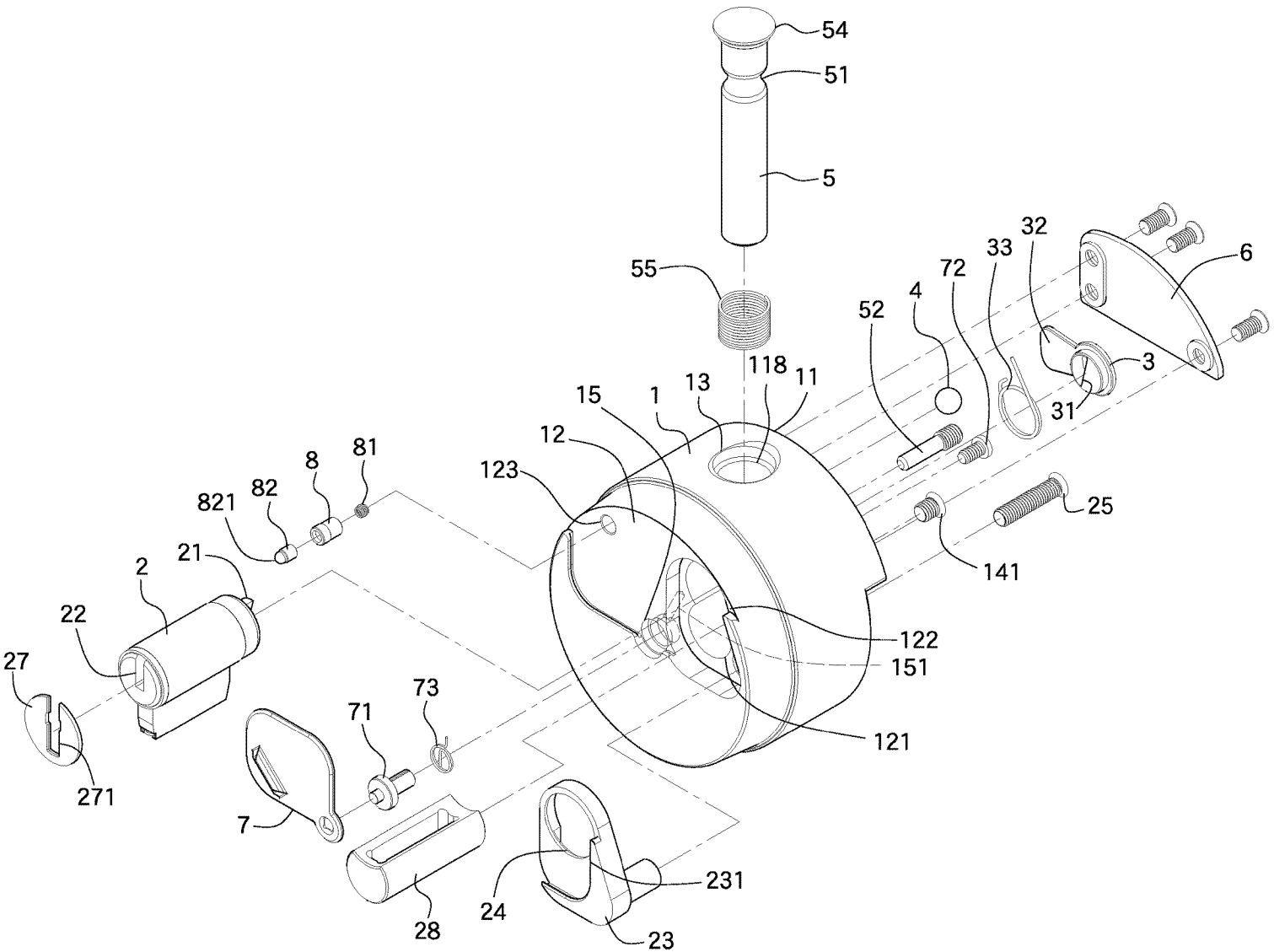
FIG. 6 is another exploded view to show the hockey lock of the present invention.

In order to prevent the shackle 5 from separating from the lateral hole 13 when at the locked position, as shown in FIGS. 5 to 7, the first end face 11 includes a threaded hole 117 which communicates with the lateral hole 13. A pin 52 is connected to the threaded hole 117. The shackle 5 includes a recess 53 which is located corresponding to the pin 52 so as to restrict the shackle 5 to be moved between the locked position and the unlocked position as shown in FIGS. 7 and 10. Furthermore, in order to ensure that the shackle 5 is removed from the first cavity 111 and moves to the unlocked position when the locking member 3 is rotated to the second position at the locked position, the lateral hole 13 includes a first shoulder 118 formed in the inner periphery thereof. The shackle 5 includes a head 54 on the top thereof. A pre-compressed resilient part 55 is biased between the head 54 and the first shoulder 118. The resilient part 55 provides a recovery force to move the shackle 5 to the unlocked position when the locking part 4 is removed from the neck 51.

Figure 11:
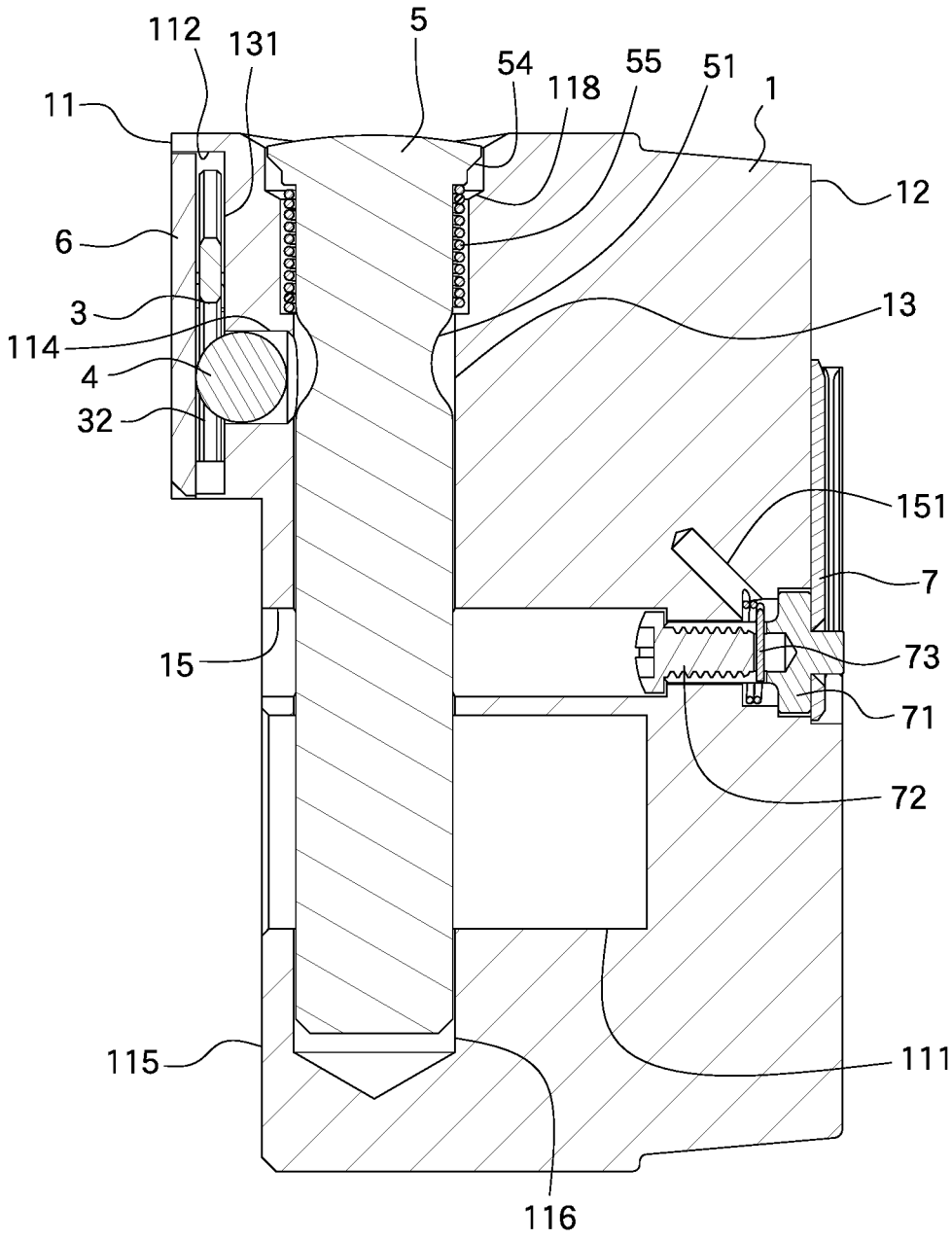
FIG. 11 is a cross sectional view, taken along line A-A in FIG. 3, and the shackle is at the unlocked position, the stop plate is not yet moved to the first position.

In order to let the shackle 5, at the unlocked position, to be pushed into the first cavity 111 from the lateral hole 13, and the locking member 3 can be moved to the first position, so that a resilient member 33 is located between the stop plate 32 and the inside wall of the second cavity 112. The resilient member 33 biases the stop plate 32 toward the first position. In this embodiment, the resilient member 33 is a torsion spring. As shown in FIG. 11, when the shackle 5 is located at the locked position, the neck 51 is located corresponding to the locking part 4, and the recovery force of the resilient member 33 drives the locking plate 3, as shown in FIGS. 7 and 8, the resilient member 33 biases the stop plate 32 toward the first position, so that the locking part 4 is pushed into the fourth cavity 114 and located corresponding to the neck 51 of the shackle 5 to position the shackle 5 at the locked position. Because the connection portion 31 is connected to the transmission portion 21, so that the core 2 is rotated with the locking plate 3.

As shown in FIGS. 5 and 6, the first end face 11 includes a fixing hole 119, and the second end face 12 includes a positioning recess 122 which communicates with the fixing hole 119. The core hole 121 is defined in the inner bottom of the positioning recess 122. A cover 23 is mounted to the positioning recess 122 so as to cover up the core 2 and the positioning recess 122. The cover 23 includes a bore 24 which communicates with the keyhole 22. A fixing member 25 extends through the fixing hole 119 and fixed to the cover 23. When replacing the core 2, the fixing member 25 is removed from the fixing hole 119, so that the core 2 and the cover 23 can be removed and replaced. After the core 2 is replaced and installed in the core hole 121, the fixing member 25 then again extends through the fixing hole 119 and fixed to the cover 23.

In order to prevent the core 2 from being damaged by hitting, the cover 23 includes a stepped face 26 facing the keyhole 22. The stepped face 26 has an anti-break plate 27 received therein. The anti-break plate 27 is located corresponding to the passage 271 of the keyhole 22. When inserting a key into the keyhole 22 and rotates the core 2, because the anti-break plate 27 is located at the stepped face 26, so that the anti-break plate 27 will contact against the inside wall of the passage 271 by the key and rotated with the core 2.

Figure 12:
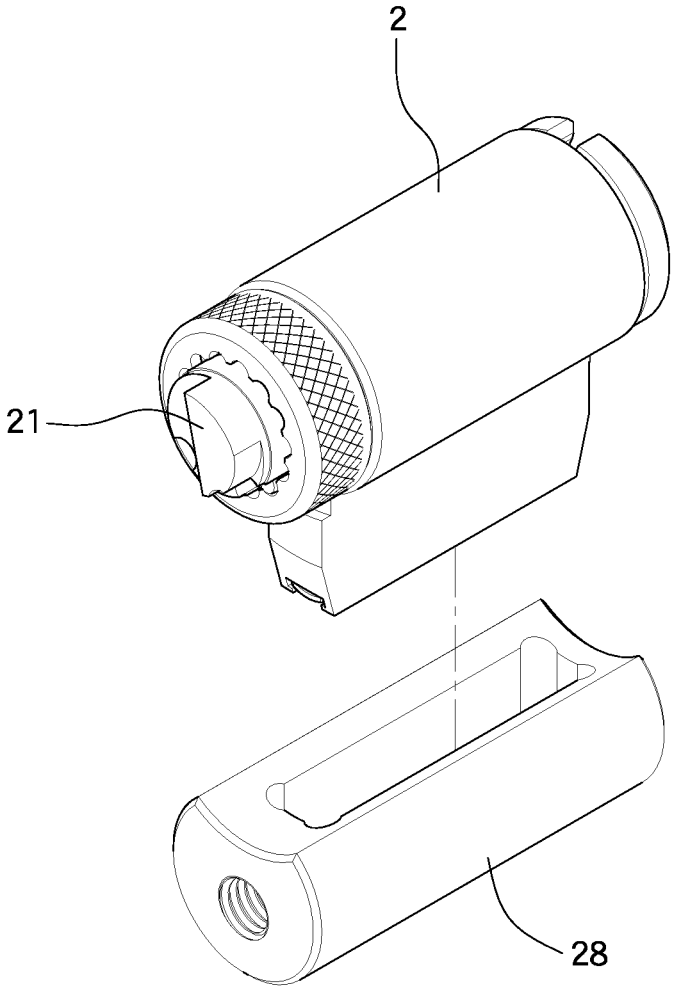
FIG. 12 shows the core and the sleeve.
Figure 13:
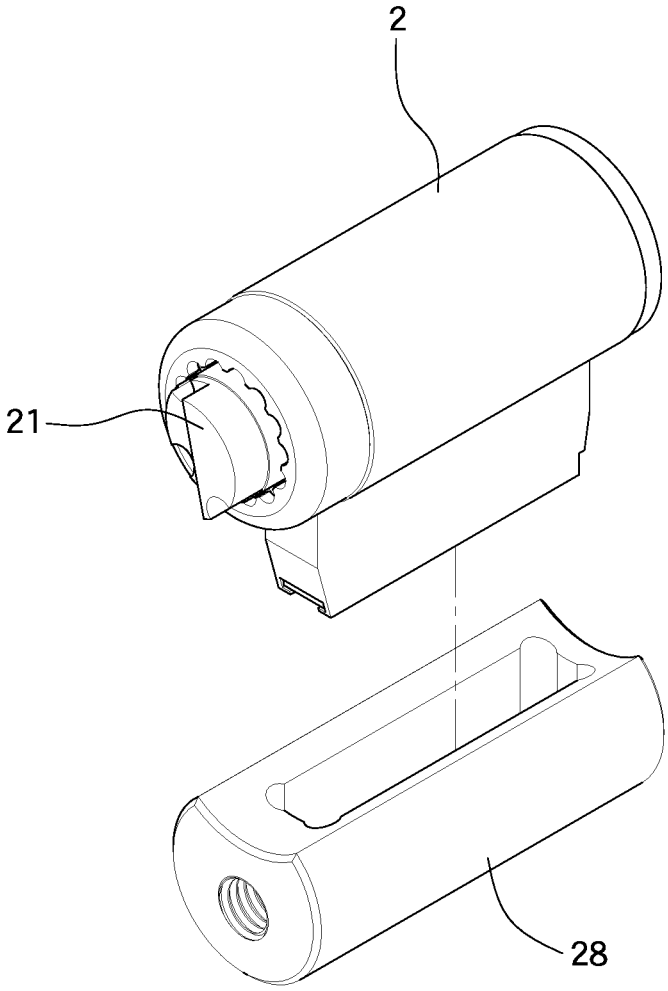
FIG. 13 shows another core and the sleeve.

The core 2 usually includes beads so that in order to allow the core hole 121 to accommodate different shapes of the cores 2, the core 2 is connected with a sleeve 28 radially. The core hole 121 is shaped to accommodate the core 2 and the sleeve 28 as shown in FIGS. 12 and 13. The sleeve 28 includes an installation hole 281 which is located corresponding to the first end face 11. The first end face 11 includes a connection hole 14, and a connection member 141 is connected to the connection hole 14 from the first end face 11 and is connected to the installation hole 281. Therefore, the core 2 is well positioned, and the core 2 is prevented from being removed by unauthorized persons, due to damaging the cover 23.

Figure 15:
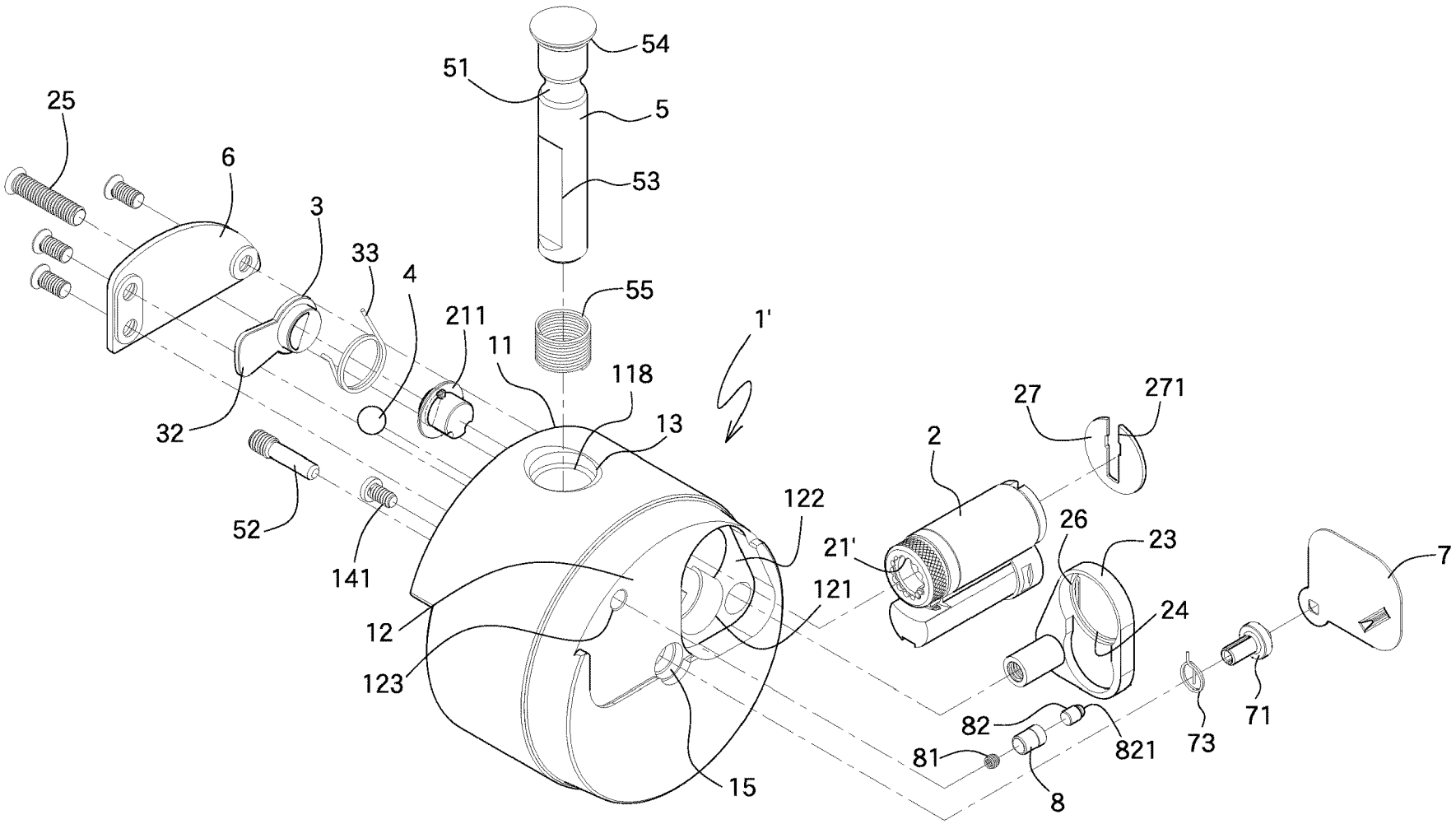
FIG. 15 shows the core and the transmission portion is a hole.
Figure 16:
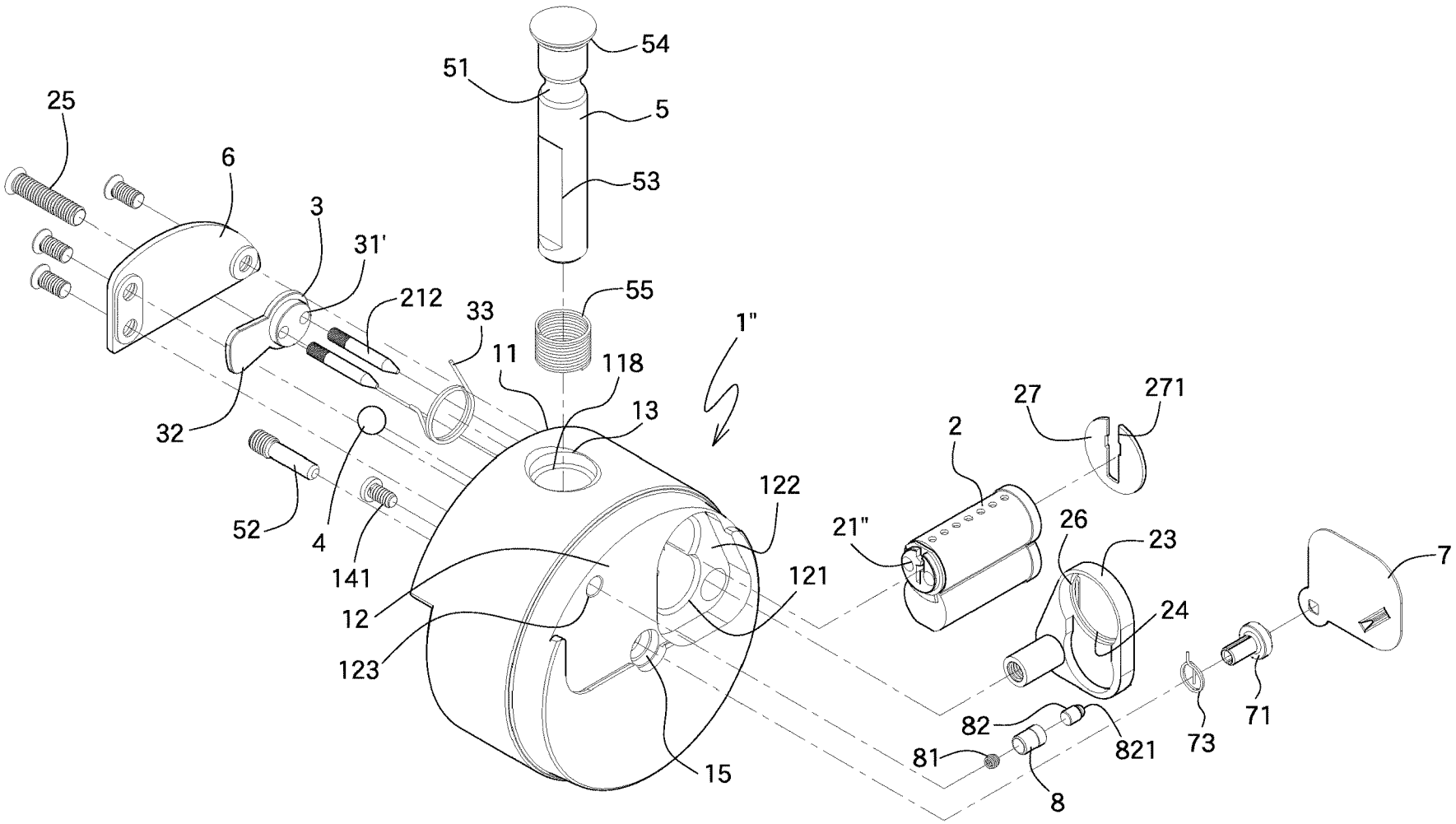
FIG. 16 shows that the outer plate is at the closed position.
Figure 17:
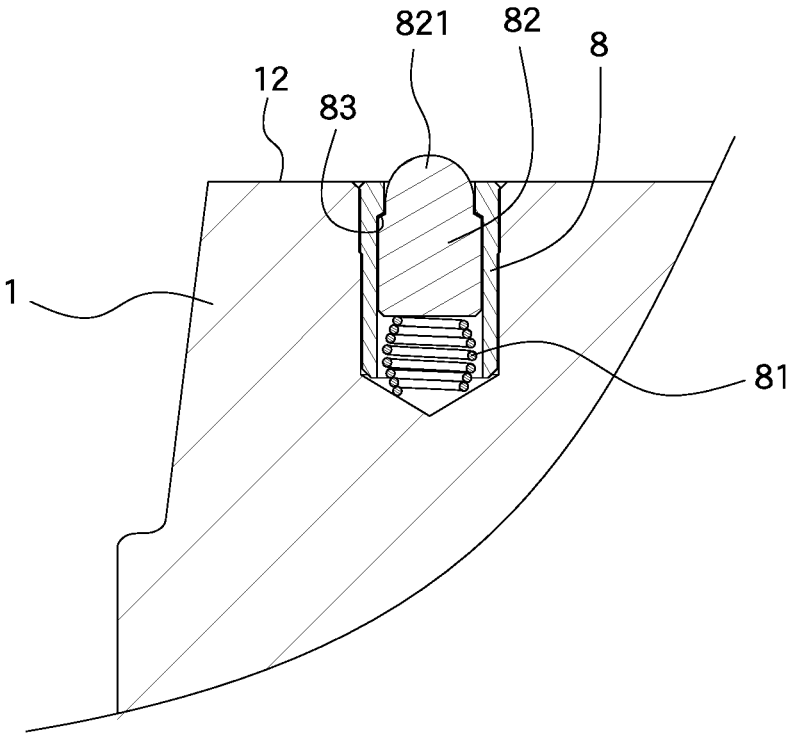
FIG. 17 is a cross sectional view, taken along line B-B in FIG. 4.

The existed cores have different shapes, as shown in this embodiment, the connection portion 31 is a protruded portion (semi-circular) and the transmission portion 21 is a notch (semi-circular) which is shaped to accommodate the protruded portion. In another embodiment, as shown in FIG. 15, the transmission portion 21' is a notch and includes a transmission member 211 which is connected to the connection portion 31. The connection portion 31 is a protruded portion and the transmission member 211 is a notch which is shaped to accommodate the protruded portion. Therefore, the core 2 with the transmission portion 21 (a notch) can be used for the lock 1 of the present invention. In yet another embodiment, as shown in FIG. 16, the transmission portion 21" is in a form of two holes, and the connection portion 31' also includes two holes. A transmission pin 212 is located between each of the two holes of the connection portion 31 and each of the two holes of the transmission portion 21. The transmission portion 21" and the connection portion 31' can be transmitted by the transmission pins 212.

Figure 14:
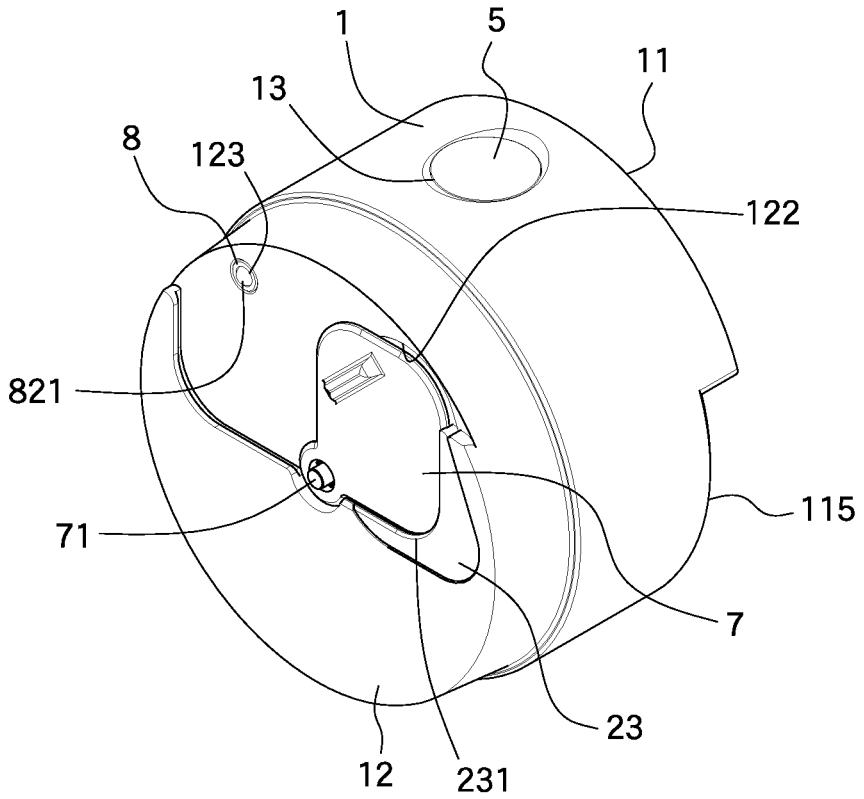
FIG. 14 shows the core and the transmission portion is a notch.

If the core 2 and the sleeve 28 of the existed lock includes specific specifications, and they cannot be installed to the core hole 121 of the present invention, the housing of the lock 1, 1', 1" of the present invention may have specific core hole 121 that matches with the core 2 and the sleeve 28 as shown in FIGS. 6, 14 and 15.

Figure 4:
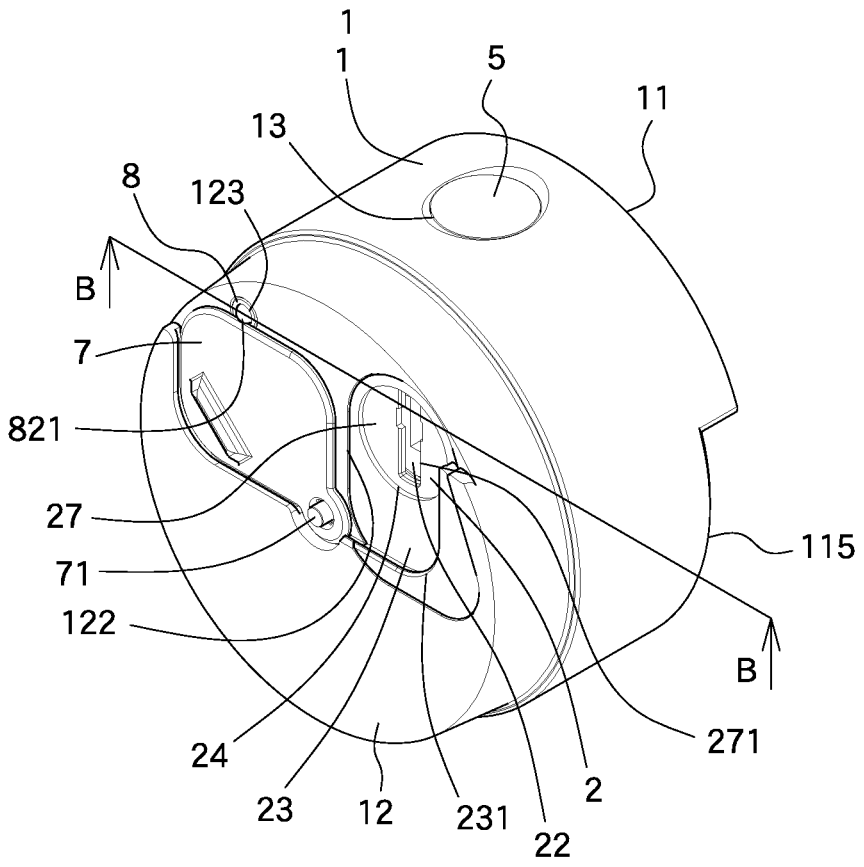
FIG. 4 is another perspective view to show the hockey lock of the present invention.

In order to prolong the life of use of the core 2, an outer plate or outer cover 7 is mounted to the second end face 12 and covers up the core 2 and the keyhole 22 when the outer plate 7 is located at a closed position as shown in FIG. 16, so as to prevent dust and rain from entering into the lock 1. When the outer plate 7 is located at an opened position as shown in FIG. 4, the outer plate 7 does not cover up the core 2 and the keyhole 22 so that the users can easily access the keyhole 22. The outer cover 7 includes a positioning pin 71. A positioning hole 15 is defined through the first and second end faces 11, 12, and located corresponding to the positioning pin 71. The positioning hole 15 includes an inclined hole 151 defined through the inside wall thereof. A positioning part 72 is located in the positioning hole 15 and connected to the positioning pin 71. A first spring member 73 is a torsion spring and is biased between the positioning pin 71 and the inside wall of the positioning hole 15 so that the positioning pin 71 drives the outer plate 7 toward the closed position. When the users lock the lock 1, the first spring member 73 ensures that the outer cover 7 covers up the core 2 and the keyhole 22.

In order to ensure that the outer cover 7 covers up the keyhole 22, the cover 23 has a restriction face 231 so that the outer cover 7 is engaged with the restriction face 231 which is a concaved face.

In one embodiment, as shown in FIGS. 4 to 6, 16 and 17, the second end face 12 includes an axial hole 123 which includes a tube 8 received therein. The tube 8 includes a second spring member 81 and an end member 82 received therein. The tube 8 includes a second shoulder 83 formed in the inner periphery thereof. The second shoulder 83 is located corresponding to the end member 82. The end member 82 includes a protrusion 821 which is shaped corresponding to the shape of the outer plate 7, and protrudes beyond the second shoulder 83. The end member 82 is biased by the second spring member 81 and the protrusion 821 protrudes beyond the axial hole 123 and the second shoulder 83. When the users insert the key into the keyhole 22 and rotate the core 2, the outer plate 7 is moved to the opened position, the outer plate 7 contacts the lateral side of the protrusion 821 by the first spring member 73. When the outer plate 7 is to be moved to the closed position, a force is applied to the outer plate 7 so that the protrusion 821 is inserted into the tube 8 so that the outer plate 7 is biased by the first spring member 73 and returns the closed position. The outer plate 7 presses the protrusion 821 which is shaped corresponding to the shape of the outer plate 7.

While we have shown and described the embodiment in accordance with the present invention, it should be clear to those skilled in the art that further embodiments may be made without departing from the scope of the present invention.

What is claimed is:

1. A core replaceable hockey lock comprising:

a first end face and a second end face which is located opposite to the first end face, the first end face including a first cavity, a second cavity, a third cavity and a fourth cavity defined therein, the second cavity communicating with the third cavity, the fourth cavity defined in an inner bottom of the third cavity, the second end face includes a core hole which communicates with the second cavity, a lateral hole defined radially in the lock and communicating with the first and fourth cavities;

a core located in the core hole and including a transmission portion on a first end thereof, a keyhole defined in a second end of the core;

a locking member located in the second cavity and including a connection portion and a stop plate, the connection portion connected to the transmission portion, the stop plate sliding in the third cavity when the locking member is rotated, when the locking member is located at a first position, the stop plate seals the fourth cavity, when the locking member is located at a second position, the stop plate does not seal the fourth cavity;

a locking part located in the fourth cavity and located corresponding to the stop plate, and a shackle located in the lateral hole and including a neck which is located corresponding to the fourth cavity and the locking part, when the shackle is located at a locked position, the shackle is located in the first cavity and the neck is located at the fourth cavity, when the locking member is located at the first position, the stop plate stops the locking part from protruding into the fourth cavity, so that the locking part is engaged with the neck, when the locking member is located at the second position, the locking part protrudes into the fourth cavity and is separated from the neck, so that the shackle is moved to an unlocked position where the shackle is not engaged with the first cavity.

2. The core replaceable hockey lock as claimed in claim 1, wherein the first end face includes a fixing hole, the second end face includes a positioning recess which communicates with the fixing hole, the core hole is defined in an inner bottom of the positioning recess, a cover is mounted to the positioning recess so as to cover up the core and the positioning recess, the cover includes a bore which communicates with the keyhole, a fixing member extends through the fixing hole and fixed to the cover.

3. The core replaceable hockey lock as claimed in claim 2, wherein the cover includes a stepped face facing the keyhole, the stepped face has an anti-break plate received therein, the anti-break plate is located corresponding to the passage of the keyhole.

4. The core replaceable hockey lock as claimed in claim 1, wherein the first end face includes at least one protection plate which is mounted to the first, second and third cavities.

5. The core replaceable hockey lock as claimed in claim 1, wherein the first end face includes a threaded hole which communicates with the lateral hole, a pin is connected to the threaded hole, the shackle includes a recess which is located corresponding to the pin so as to restrict the shackle to be moved between the locked position and the unlocked position.

6. The core replaceable hockey lock as claimed in claim 5, wherein the lateral hole includes a first shoulder formed in an inner periphery thereof, the shackle includes a head on a top thereof, a pre-compressed resilient part is biased between the head and the first shoulder.

7. The core replaceable hockey lock as claimed in claim 1, wherein the first cavity includes a fifth cavity defined in an inside wall thereof, the fifth cavity is located corresponding to the lateral hole, when at the locked position, the shackle is engaged with the fifth cavity.

8. The core replaceable hockey lock as claimed in claim 1, wherein the core is connected with a sleeve radially, the core hole is shaped to accommodate the core and the sleeve.

9. The core replaceable hockey lock as claimed in claim 8, wherein the sleeve includes an installation hole which is located corresponding to the first end face, the first end face includes a connection hole, a connection member is connected to the connection hole from the first end face and is connected to the installation hole.

10. The core replaceable hockey lock as claimed in claim 1, wherein a resilient member is located between the stop plate and an inside wall of the second cavity.

11. The core replaceable hockey lock as claimed in claim 10, wherein the resilient member is a torsion spring.

12. The core replaceable hockey lock as claimed in claim 1, wherein the locking part is a ball.

13. The core replaceable hockey lock as claimed in claim 1, wherein the first end face includes a recessed face, the first cavity is defined in an inner bottom of the recessed face.

14. The core replaceable hockey lock as claimed in claim 1, wherein an outer plate is mounted to the second end face and covers up the core and the keyhole when the outer plate is located at a closed position, when the outer plate is located at an opened position, the outer plate does not cover up the core and the keyhole, the outer plate includes a positioning pin, a positioning hole is defined through the first and second end faces, the positioning hole is located corresponding to the positioning pin and includes an inclined hole defined through an inside wall thereof, a positioning part is located in the positioning hole and connected to the positioning pin, a first spring member is a torsion spring and is biased between the positioning pin and the inside wall of the positioning hole so that the positioning pin drives the outer plate toward the closed position.

15. The core replaceable hockey lock as claimed in claim 14, wherein the second end face includes an axial hole which includes a tube received therein, the tube includes a second spring member and an end member received therein, the tube includes a second shoulder formed in an inner periphery thereof, the second shoulder is located corresponding to the end member, the end member includes a protrusion which protrudes beyond the second shoulder, when the outer plate is located at the opened position, the outer plate contacts a lateral side of the protrusion by the first spring member.

16. The core replaceable hockey lock as claimed in claim 1, wherein the connection portion is a protruded portion and the transmission portion is a notch which is shaped to accommodate the protruded portion.

17. The core replaceable hockey lock as claimed in claim 1, wherein the transmission portion is a notch and includes a transmission member which is connected to the connection portion, the connection portion is a protruded portion and the transmission member is a notch which is shaped to accommodate the protruded portion.

18. The core replaceable hockey lock as claimed in claim 1, wherein the connection portion and the transmission portion each are a hole, a transmission pin is located between the connection portion and the transmission portion.

* * * * *